United States Patent [19]

Compton

[11] 4,272,361

[45] Jun. 9, 1981

[54] METHOD FOR REDUCING THE NITROGEN CONTENT OF SHALE OIL

[75] Inventor: Leslie E. Compton, Claremont, Calif.

[73] Assignee: Occidental Research Corporation, Irvine, Calif.

[21] Appl. No.: 52,638

[22] Filed: Jun. 27, 1979

[51] Int. Cl.[3] ..... C10G 17/04; C10G 17/10

[52] U.S. Cl. ..... 208/254 R; 208/265; 208/282; 208/290

[58] Field of Search ..... 208/254 R, 324, 265, 208/282; 260/705

[56] References Cited

U.S. PATENT DOCUMENTS

| | | | |
|---|---|---|---|
| 2,035,102 | 3/1936 | Stratford et al. | 208/324 |
| 2,263,176 | 11/1941 | Lazar et al. | 208/254 R |
| 2,309,324 | 1/1943 | McAllister et al. | 260/705 |
| 2,541,458 | 2/1951 | Berg | 260/705 |
| 2,662,843 | 12/1953 | Castner et al. | 208/254 R |
| 2,704,758 | 3/1955 | Wetzel | 546/181 |
| 4,159,940 | 4/1979 | Smith | 208/254 H |

*Primary Examiner*—Delbert E. Gantz
*Assistant Examiner*—G. E. Schmitkons
*Attorney, Agent, or Firm*—Christie, Parker & Hale

[57] ABSTRACT

A method is disclosed for reducing the nitrogen content of shale oil by removing nitrogen-containing compounds from the shale oil. The shale oil containing nitrogen-containing compounds is extracted with a sufficient amount of selective solvent which is selective toward the nitrogen-containing compounds present in the shale oil. The selective solvent comprises an active solvent for nitrogen-containing compounds and water in an amount sufficient to provide phase separation. The active solvent component of the selective solvent is selected from the group consisting of organic acids, and substituted organic acids, particularly acetic, formic and trichloroacetic acids and mixtures thereof. The selective solvent containing the nitrogen-containing compounds is separated from the reduced nitrogen content shale oil raffinate by phase disengagement.

11 Claims, No Drawings

METHOD FOR REDUCING THE NITROGEN CONTENT OF SHALE OIL

BACKGROUND OF THE INVENTION

The method herein relates to reducing the nitrogen content of shale oil by extracting the shale oil with an organic acid.

More particularly, the method herein relates to a method for reducing the nitrogen content of shale oil produced in an in situ oil shale retort.

The term "oil shale" as used in the industry is, in fact, a misnomer; it is neither shale nor does it contain oil. It is a sedimentary formation comprising marlstone deposits with layers containing an organic polymer called "kerogen" which, upon heating, decomposes to produce liquid and gaseous products. The formation containing kerogen is called "oil shale" herein and the liquid product produced upon decomposition of kerogen is called "shale oil."

Kerogen is considered to have been formed by the deposition of plant and animal remains in marine and nonmarine environments. Its formation is unique in nature. Alteration of this deposited material during subsequent geological periods produced a wide variety of organic materials. Source material and conditions of deposition were major factors influencing the type of final product formed.

Kerogen samples, found in various parts of the world, have nearly the same elemental composition. However, kerogen can consist of many different compounds having differing chemical structures. Some compounds found in kerogen have the structures of proteins while some have structures of terpenoids, and others have structures offasphalts and bitumens.

Shale oils produced from oil shale are generally high molecular weight, viscous organic liquids, predominantly hydrocarbonaceous compounds including oxygen, nitrogen and sulfur containing organic compounds. The shale oils are of varying linear, branched cyclic aromatic hydrocarbon and substituted hydrocarbon content with high pour points, moderate sulfur content and relatively high nitrogen content. As the composition of shale oil depends upon the composition of the kerogen within the oil shale formation, the composition of the shale oil can vary from one geographic location to another. The shale oil produced from an oil shale formation can vary also between strata within the oil shale formation. The nitrogen content of shale oil can also vary dependent upon the geographical location of the oil shale deposit from which the shale oil is produced. Such a variance in nitrogen content in different geographical locations can be attributed to differences in the environment during the time of the deposition of the organisms which, upon lithification, became oil shale. Such a variance can also be attributed to the different types of organisms in the separate geographical locations which were deposited to form the organic substance in the oil shale and any organisms within the formed deposit layer which acted upon such deposited material to provide the kerogen within the oil shale formation.

The nitrogen content in shale oil is attributable to basic nitrogen-containing compounds and nonbasic nitrogen-containing compounds. The relative percentages of the basic and nonbasic nitrogen compounds comprising the total nitrogen content of a shale oil can also vary depending upon the particular shale oil.

The nitrogen content of shale oil is generally up to about two percent by weight with shale oil from some deposits having greater than two percent by weight nitrogen content. The average nitrogen content of shale oil recovered by in situ retorting of oil shale from the Piceance Creek Basin of Western Colorado is about 1.4 percent by weight.

The presence of nitrogen in shale oil presents many problems in that the nitrogen can interfere with the transportation and use of the shale oil. Deleterious effects brought about by the presence of nitrogen in shale oil are decreased catalyst life in dehydrogenation, reforming, hydrocracking and catalytic cracking reactions, decreased chemical stability of products, and decreased color stability of products. Another problem with the presence of nitrogen in shale oil is that it is undesirable to transport nitrogen-containing shale oil through pipelines which are also used for transporting petroleum products because of possible pollution of such products with residual nitrogen-containing shale oil in the pipeline. Generally such petroleum products contain a very low nitrogen content. The relatively high nitrogen content in the shale oil can pollute the pipelines making them undesirable and uneconomical for transporting such low nitrogen-containing petroleum products. In addition, high nitrogen content in shale oil can cause clogging of pipelines due to self-polymerization brought about by the reactivity of the nitrogen-containing compounds. Due to the basicity of the nitrogen-containing compounds in shale oil some corrosion can occur thus damaging a pipeline used to transport shale oil.

Product stability is a problem that is common to many products derived from shale oil with the major exception of the asphalt cut and those products that have undergone extensive hydrotreating. Such instability, including photosensitivity, is believed to be resultant, primarily from the presence of nitrogen-containing compounds.

It is, therefore, desirable to reduce the nitrogen content of shale oil to increase the utility, transportability, and stability of the shale oil and the products derived from such shale oil.

Due to the undesirable nature of nitrogen in organic fluid streams, such as fluid streams produced in the recovery and refining of petroleum, coal and oil shale, many processes have been developed to reduce the nitrogen content to an acceptable level. The level of acceptability for the nitrogen content is generally based upon the use of the particular stream.

In U.S. Pat. No. 3,719,587 to Karchmer et al a process is disclosed for removing basic nitrogen-containing compounds from coal naphtha. The basic nitrogen compounds are removed by washing the naphtha with water or with a dilute aqueous solution of a strong acid. The dilute acid solutions are disclosed as from 0 to 10 weight percent of the acid such as sulfuric acid, hydrochloric acid, phosphoric acid and acetic acid.

U.S. Pat. No. 2,848,375 to Gatsis discloses a process for removing basic nitrogen compounds from organic substances by washing with a weak acid in combination with a polyalcohol. The weak acid used is boric acid in combination with a polyhydroxy organic compound which has hydroxyl groups on adjacent carbons.

U.S. Pat. No. 2,741,578 to McKinnis teaches that mineral oils can be treated to recover the nitrogen bases by extracting the mineral oils with a selective solvent for the nitrogen bases. The selective solvents are organic hydroxy compounds. Organic hydroxy compounds which can be used are the compounds which have a pH greater than 6.5.

U.S. Pat. No. 2,035,583 to Bailey discloses a process for the separation and recovery of nitrogen bases from mineral oils. In the process, the mineral oil is extracted with a solvent for the nitrogen bases. Acceptable solvents are liquid sulfur dioxide, furfural, aniline, nitrobenzene and isobutyl alcohol. However, due to the solubility of desirable mineral oils, such as aromatics and olefins, the process also includes extracting the resultant extract with dilute aqueous acids to recover the nitrogen bases from the first extract. The nitrogen bases are then recovered from the aqueous solution by adding an inorganic base to precipitate the nitrogen bases.

U.S. Pat. No. 2,035,102 to Stratford et al discloses a process for improving the color and viscosity of petroleum oils. In the process an oil is extracted with a selective solvent in combination with an acid. The selective solvent can be phenol, nitrobenzene, furfural or liquid sulfur dioxide. The acid is preferably an inorganic acid but can also be an organic acid such as picric, acetic, oxalic, citric and benzene sulfuric acids.

U.S. Pat. No. 2,541,458 to Berg discloses a process for recovery of nitrogen bases from hydrocarbon fractions. In the process the fraction is extracted with a volatile acid or nonvolatile acid salt in combination with a mutual solvent for the acid and the hydrocarbon fraction. The mutual solvents include low boiling alcohols and ketones. The extraction is conducted in the presence of water to avoid loss of the volatile acids.

U.S. Pat. No. 2,309,324 to McAllister et al discloses a method for removing nitrogen bases from water-insoluble organic solvents, mineral oils and hydrocarbon fractions. In the process the mineral oil is extracted with an aqueous, weak acid solution. The weak acids are classified as acids having dissociation constants below $10^{-3}$. The aqueous acid solutions are prepared by dissolving from 15 to 90 weight percent of an acid in water. Upon extraction of the oil, two phases are formed. The aqueous phase contains the acid and absorbed nitrogen bases. The other phase consists of the organic substance from which at least a portion of the nitrogen bases has been removed.

Many of the processes described in the above processes do not address themselves to the removal of nonbasic nitrogen compounds which can be present in organic fluids. Additionally, many of the above described processes are not specific for treatment of shale oil and the relatively high nitrogen content found in shale oil. Still further, none of the above processes are specific for lowering the nitrogen content for shale oil produced by in situ retorting of oil shale.

SUMMARY OF THE INVENTION

The present invention is directed to a method for the refining of shale oil wherein the nitrogen content of the shale oil is reduced by extracting the shale oil with a selective solvent system comprising an acid selected from formic acid, acetic acid and trichloroacetic acid, in admixture with up to ten percent by weight water. The water is present to provide for two-phase formation and inhibit loss of non-nitrogen-containing shale oil into the extractant. The acid, with up to ten percent by weight water, is referred to herein as the "selective solvent."

Shale oil produced by the retorting of oil shale is a liquid product which predominantly contains liquid hydrocarbons and some substituted liquid hydrocarbons such as oxygen and nitrogen substituted hydrocarbons. A selective solvent which selectively substantially dissolves nitrogen-containing compounds present in shale oil is added to the shale oil in an amount sufficient to dissolve at least a portion of such nitrogen-containing compounds. The amount of selective solvent that is sufficient depends upon the solubility of such nitrogen-containing compounds in the selective solvent and the amount of such nitrogen-containing compounds in the shale oil. The selective solvent can also dissolve or otherwise retain some of the non-nitrogen-containing compounds present in shale oil. For this reason, during an extraction of the shale oil with a selective solvent some desirable compounds can be lost in the extractant. Therefore, the amount of selective solvent used is determined by balancing nitrogen-containing compound extraction capabilities of the selective solvent against the amount of non-nitrogen-containing compounds also extracted. Selective solvents which are useful in extracting the nitrogen-containing compounds comprise a mixture of water and an organic acid selected from the group consisting of formic acid, acetic acid and trichloroacetic acid and mixtures thereof. The water is present in an amount up to about 10 percent by weight. This amount of water is sufficient to provide phase separation between the shale oil and selective solvent. Such selective solvents do not dissolve or otherwise remove liquid hydrocarbons present in the shale oil to any appreciable extent. Further, such selective solvents are sufficiently insoluble in shale oil that a multiple layer system is provided when mixed with shale oil. Separating the resultant layers provides a separation of nitrogen-containing compounds from shale oil.

DETAILED DESCRIPTION OF THE INVENTION

This invention relates to the refining of shale oil and, more particularly, to the reducing of nitrogen content of shale oil.

As used herein, the term "crude shale oil" refers to the liquid product that is recovered from retorting of oil shale. The term encompasses liquid products formed during the retorting of oil shale either through aboveground retorting processes or in situ oil shale retorting processes which products have not undergone any further processing other than water removal or emulsion breaking. The term "processed shale oil" is used herein to indicate a crude shale oil which has undergone some processing, such as, for example, sulfur removal, fractionation, and the like. As used herein, the term "refined shale oil" refers to a crude shale oil or a processed shale oil which has been processed through the method of this invention to reduce the nitrogen content of such shale oil. The "refined shale oil," therefore, has a lower nitrogen content than the crude shale oil or processed shale oil undergoing the method herein disclosed.

In a preferred practice of this method, the method is utilized for refining shale oil produced from in situ retorting of oil shale. An in situ oil shale retort can be formed by many methods, such as the methods disclosed in U.S. Pat. Nos. 3,661,423; 4,043,595; 4,043,596; 4,043,597; and 4,043,598, all of which are incorporated herein by this reference.

In preparing an in situ oil shale retort, formation from within the boundaries of a retort site is excavated to form at least one void, leaving a remaining portion of unfragmented formation within the boundaries of the retort being formed. The remaining portion of unfragmented formation is explosively expanded toward such a void to form a fragmented permeable mass of formation particles containing oil shale within the retort boundaries.

One method of forming an in situ oil shale retort is by exacavating at least one columnar void, such as in the form of a vertical slot, for providing vertical free faces of formation on opposite sides of the slot in the retort site. Blasting holes are drilled in the unfragmented formation adjacent the vertical slot and parallel to such a free face. Explosive is loaded into the blasting holes and detonated to explosively expand formation adjacent the slot toward the vertical free faces to form a fragmented permeable mass of formation particles containing oil shale within the in situ retort being formed. Further details of techniques for forming a fragmented mass employing a columnar void are disclosed in aforementioned U.S. Pat. Nos. 4,043,595 and 4,043,596.

In another method of forming in situ oil shale retorts, the void excavated within the retort site can be a horizontal void for providing horizontal free faces of formation, toward which unfragmented formation within the retort site can be explosively expanded. After completion of the excavation of such horizontal void or voids, vertical blasting holes are drilled through the unfragmented formation remaining within the retort site. Explosive is placed into the blasting holes and subsequently detonated for explosively expanding the unfragmented formation toward the horizontal free face. Further details of techniques for forming retorts using such horizontal voids are more fully described in the aforementioned U.S. Pat. Nos. 4,043,597 and 4,043,598.

After the fragmented mass is formed, the final preparation steps for producing liquid and gaseous products are carried out. These steps include drilling a plurality of feed gas inlet passages downwardly to the fragmented mass so that an oxygen-supplying gas can be supplied to the fragmented mass during retorting operations. Alternatively, the upper ends of blasting holes used in forming the fragmented mass can be cleaned and used for introducing gas to the retort. The fragmented mass connects to a product removal drift at the lower end of the fragmented mass.

During retorting operations, formation particles at the top of the fragmented mass are ignited to establish a combustion zone. An oxygen-supplying gas, such as air, is introduced to the combustion zone through the inlet passages. The oxygen-supplying gas introduced to the fragmented mass maintains the combustion zone and advances it downwardly through the fragmented mass. Combustion gas produced in the combustion zone passes through the fragmented mass to establish a retorting zone on the advancing side of the combustion zone wherein kerogen in the fragmented mass is converted to liquid and gaseous products. As the retorting zone moves downwardly through the fragmented mass, liquid and gaseous products are released from the fragmented formation particles. A sump in a portion of a drift connected to the lower end of the fragmented mass collects liquid products produced during operation of the retort. Off gas is also withdrawn through such drift to above ground.

Although the process disclosed herein of reducing the nitrogen content of shale oil is primarily discussed in relation to shale oil produced from the in situ retorting of oil shale, the process can be practiced on shale oil produced by other methods of retorting. Many of these methods for shale oil production are described in *Synthetic Fuels Data Handbook,* complied by Dr. Thomas A. Hendrickson, and published by Cameron Engineers, Inc., Denver, Colorado. For example, other processes for retorting oil shale include those known as the TOSCO, Paraho Direct, Paraho Indirect, N-T-U, and Bureau of Mines, Rock Springs, processes.

The TOSCO retorting process is described on pages 75 and 76 of the *Synthetic Fuels Data Handbook* and the United States Patents mentioned therein, including U.S. Pat. No. 3,025,223. Generally speaking, this process involves preheating minus ½ inch oil shale to about 500° F. in a fluidized bed. Pyrolysis is completed in a rotating drum heated by ceramic balls which are separately heated in a ball-heating furnace.

The Paraho process is described at pages 62, 63, 84 and 85 of the *Synthetic Fuels Data Handbook* and the U.S. Patents referred to therein. The Paraho process employs a vertical kiln through which ground oil shale moves downwardly as gas moves upwardly. Combustion air can be admitted into the bed of oil shale particles for direct heating of oil shale by combustion within the bed. This process is referred to as Paraho Direct. The kiln can also be arranged so that recycled gas can be heated externally, then injected into the bed of oil shale for indirect heating of the oil shale. Such a process is referred to as Paraho Indirect.

The N-T-U process is a batch process as described at page 59 of the *Synthetic Fuels Data Handbook* and the United State patents referred to therein. In the N-T-U process, a retort is filled with a batch of oil shale particles and ignited at the top. Combustion is supported by air injection and a combustion zone is passed downwardly through the stationary bed of shale. Recycled gas from the bottom of the retort is mixed with the combustion gas to modulate temperatures and provide some of the fuel requirement.

The Bureau of Mines, Rock Springs process is described in the *Synthetic Fuels Data Handbook* and also in Paper No. SPE-6067 prepared for the 51st Annual Technical Conference and Exhibition of the Society of Petroleum Engineers of AIME, held in New Orleans, Oct. 3–6, 1976, by R. L. Wise, et al. Such a process is also described in U.S. Pat. No. 3,346,044, among others. Generally speaking, this process involves fracturing of an underground oil shale formation with the fractures propped open with sand. Injection and production wells are drilled into the formation. A combustion zone is moved from an injection well towards one or more production wells for retorting oil shale in the fractured formation.

Nitrogen is removed from shale oil in the method herein by mixing the shale oil with a selective solvent which is selective to nitrogen-containing compounds present in the shale oil. Upon mixing the selective solvent with the shale oil, nitrogen-containing compounds are extracted from the shale oil and are dissolved in or absorbed by the selective solvent. Selective solvents which are useful in extracting nitrogen-containing compounds from shale oil comprise a mixture of water and an organic acid selected from the group consisting of formic acid, acetic acid, trichloroacetic acid and mixtures thereof.

Preferably, the amount of water mixed with the formic, acetic and/or chloroacetic acid is up to about ten percent by weight. The water is added to make the acid immiscible with the shale oil. Generally, formic acid, acetic acid and trichloroacetic acid are miscible with shale oil. An amount of water that is up to about ten percent by weight of the selective solvent is sufficient to bring about immiscibility such that phase production and disengagement is provided. Preferably, the selective solvent is at least one percent by weight water to provide such immiscibility. The phase production and disengagement provided by this amount of water is sufficient for effectively separating the selective solvent containing the nitrogen-containing compounds from the shale oil. Such an amount of water is also sufficient to prevent any appreciable dissolving of non-nitrogen-containing shale oil in the selective solvent. This amount of water is also sufficient to prevent any appreciable loss of the acid portion of the selective solvent by being dissolved in the shale oil. For selective solvents having a water content greater than ten percent by weight there is less nitrogen extraction from the shale oil. That is, the nitrogen content remaining in the shale oil after such an extraction using a selective solvent with greater than ten percent by weight water remains undesirably high in comparison to using a selective solvent having a water content of up to ten percent by weight.

Extraction of the shale oil with the selective solvent can be performed in batch or continuous extraction processes. Such continuous extraction processes using cocurrent or countercurrent extraction techniques. In liquid phase batch extraction there can be employed a series of multi-stage batch extractions to improve overall efficiency of the extraction and to optimize nitrogen-containing compound removal. Similarly, cocurrent and/or countercurrent extraction can also be conducted utilizing extraction columns arranged in series to optimize the nitrogen-containing compound removal.

The amount of selective solvent that is required for extracting nitrogen-containing compounds from shale oil depends upon the nitrogen content in the shale oil and the solubility of such nitrogen-containing compounds in the selective solvent. The ratio of shale oil to selective solvent can be from about 0.20 to about ten parts by weight shale oil to one part by weight selective solvent. Generally, a significant excess of the selective solvent is utilized to insure the highest probability of encountering the nitrogen-containing compounds with the selective solvent and thereby solvation of the nitrogen-containing compounds with the selective solvent.

Along with nitrogen removal from the shale oil through extraction with the selective solvent, there is some inherent loss of shale oil by the extraction procedure. For example, some of the non-nitrogen-containing shale oil is carried away in the selective solvent following the separation. The most efficient separation process is a process which removes the greatest amount of nitrogen with little accompanying shale oil loss. Separation efficiency can be determined by measuring the nitrogen concentration and the shale oil concentration in the selective solvent extract phase. The higher the nitrogen concentration in the extract the more efficient is the process. Every time a nitrogen atom is removed from shale oil by the extraction process, the organic molecule on which that nitrogen is bonded is also extracted adding to the weight of the extract. The maximum efficiency of the process is thereby limited by the molecular weight distribution of the nitrogen-bearing compounds in the shale oil and can be approached by preventing non-nitrogen compounds from dissolving in the selective solvent and by selectively dissolving smaller nitrogen-containing molecules.

The extraction process is conducted by combining the selective solvent extractant with either a crude or a processed shale oil. The selective solvent and shale oil are thoroughly intermixed to achieve equilibrium rapidly. Such intermixing can be conducted, for example, by agitation in the batchwise extraction techniques or by the current flow in continuous flow extraction techniques.

Following the contact phase of the extraction process the selective solvent extractant is separated from the shale oil. The separation is possible due to the immiscibility of the selective solvents in shale oil. The immiscibility of the selective solvent in shale oil provides liquid-liquid phase formation whereupon one phase comprises substantially nitrogen-free shale oil and the other phase comprises substantially selective solvent and nitrogen-containing compounds. The two phases are separated by decanting, withdrawing the lower phase or by other conventional liquid-liquid separation techniques. To facilitate complete separation of the two phases of the mixture an emulsion breaker can be added to the mixture.

The nitrogen content of shale oil can be lowered by conducting successive extractions of the shale oil with selective solvent. Successive extractions can be conducted in the batchwise operation by separating the shale oil raffinate from the selective solvent pregnant with nitrogen-containing compounds after an initial extraction. The shale oil raffinate can then be extracted with non-pregnant selective solvent. Such successive extractions can be continued until the nitrogen content in the raffinate shale oil has been lowered to the desired level. Successive extractions can be conducted in continuous extraction operation by transferring the shale oil raffinate effluent from one extraction column into a second extraction column having a flow of non-pregnant selective solvent.

After the pregnant selective solvent phase is separated from the shale oil raffinate having a reduced nitrogen content, the selective solvent can be recovered. The selective solvent is recovered by separating the extracted portion of shale oil containing the nitrogen-containing compounds from the selective solvent. For example, some of the nitrogen-containing compounds that are basic can be precipitated from the selective solvent by adding a stronger base or the nitrogen-containing compounds can be extracted from the selective solvent in an extraction process. In another method the selective solvent can be volatilized and recovered to separate it from the extracted shale oil containing the nitrogen-containing compounds. The selective solvent so recovered can be recycled for use in subsequent extracting steps to reduce the nitrogen content of other shale oils.

The extracted shale oil recovered from the selective solvent can be useful because of its high nitrogen content. For example, the extracted shale oil can be used in the production of nitrogen compounds and various chemical intermediates containing nitrogen. When the selective solvent is volatilized, the residue can be used as an asphalt which provides good adhesive properties because of its nitrogen content and ability to cross-link through such nitrogen present.

The following examples illustrate the method herein described for reducing the nitrogen content of shale oil.

EXAMPLES 1-25

In these examples 1-25, extractions were made using various concentrations of both formic acid and acetic acid at various shale oil to selective solvent ratios. The shale oil was brought into contact with an aqueous solution of either formic or acetic acid. The two phases were agitated thoroughly to achieve equilibrium between the shale oil and selective solvent phases.

Complete separation of the two phases formed was brought about by centrifuging the mixtures. An emulsion breaker was added when needed. Following separation, the phases were both analyzed for nitrogen, water, and organic acid content. Second and third stage extractions were carried out by contacting the raffinates (shale oil phase) of the previous extraction step with fresh selective solvent. Mass and component balances were maintained around each separate stage.

Three different shale oil samples were used in the experimentation. The three types of shale oil used in the experiments were all samples of shale oil produced from in situ retorting of oil shale from the Piceance Creek Basin in Western Colorado. The shale oil samples were (W) emulsified oil containing about 12.67 percent water, (D) the emulsified oil of the first sample with the water removed by vacuum distillation, and a processed shale oil (L) having a low pour point, low boiling point and substantially water free. In the experiments using shale oil-water emulsion, the water in the emulsion was included in the calculation of the total water in the system as if it had been added along with the solvent components. Essentially no differences were noted in the responses of these three shale oil samples to the extraction process. The unprocessed shale oil used in the experiments contained about 1.3 percent nitrogen when corrected to zero water content.

The following Tables I-IV summarize the data from examples 1-25 using acetic acid and formic acid as the selective solvents. With the exception of example 13, the extractions were carried out using three separate extraction stages. The component weight ratios in each stage are indicated in the Tables. The water present in the samples in the aqueous acid solutions and the shale oil is combined to provide the indicated water ratio.

The amount of nitrogen remaining in the raffinate shale oil is calculated for the shale oil in the raffinate corrected to zero water and acid content. The shale oil recovered in the raffinate excludes water and acid and is calculated as weight percentage of initial shale oil for each stage and is cumulative over the total extraction. This figure is normalized to 100 percent shale oil mass balance by dividing by the total percentage of shale oil recovered in both the selective solvent and raffinate phases. The nitrogen content of the extracted shale oil, i.e., the nitrogen content of the oil in the pregnant selective solvent phase, is derived from analysis of the extract solution following separation from the raffinate but without isolation of the shale oil from the selective solvent. The higher the value of this number the greater the efficiency of the separation, i.e., the greatest amount of nitrogen-containing compounds were removed with the least amount of shale oil removal in the extract. The oil dissolved in the solvent phase indicates the weight percent concentration of shale oil, whether nitrogen bearing or not, dissolved in the selective solvent for each extraction step.

The nitrogen contents of the phases were determined by modified Kjeldahl procedure. Karl Fisher titration was used to obtain water concentrations. Acetic acid and formic acid concentrations were derived from pH curves of sodium hydroxide titrations of the samples. The shale oil composition of each phase was obtained by subtracting the water and acid weight percent concentrations from 100 percent. The accuracy of the composition analysis ratios was correlated by mass balance determinations on the components.

The results of the extraction processes show that a nitrogen level between 1 percent and 0.1 percent can be obtained by varying the acid concentration, the acid, and the oil/solvent ratio of the extraction. Extractions conducted with more concentrated acid solutions indicate a removal of more nitrogen-rich oil, with acetic acid extracts being richer in nitrogen than those of formic acid. However, extractions using the less concentrated acids reduced the nitrogen content in the raffinate shale oil to acceptable levels.

TABLE I

ACETIC ACID EXTRACTION DATA

| Example No. | | System Weight Ratios Oil:$H_2O$:Acetic | Oil:Solvent | Stage | N Content of Raffinate Oil Wt. % | Oil Recovered in Raffinate, Wt. % Each Stage | Cumulative | N Content of Extracted Oil Wt. % | Oil Dissolved in Solvent Phase Wt. % of Solution |
|---|---|---|---|---|---|---|---|---|---|
| | | 30% Acetic | | | | | | | |
| 1 | D | 31:2.4:1 | 9.1:1 | 1 | 1.14 | 99.25 | — | 9.52 | 8.40 |
| | | 29:2.6:1 | 8.1:1 | 2 | 1.18 | 99.48 | 98.73 | 13.80 | 4.42 |
| | | 19:1.7:1 | 7.0:1 | 3 | 1.03 | 99.21 | 97.95 | 8.29 | 6.15 |
| | | 50% Acetic | | | | | | | |
| 2 | D | 6.0:1:1.1 | 2.9:1 | 1 | 1.01 | 97.62 | — | 12.02 | 6.82 |
| | | 5.4:1:1.1 | 2.6:1 | 2 | 0.895 | 97.65 | 95.33 | 5.42 | 6.64 |
| | | 5.4:1:1.2 | 2.5:1 | 3 | 0.781 | 98.05 | 89.42 | 3.98 | 5.28 |
| 3 | L | 2.1:1:1.1 | 1.0:1 | 1 | 0.865 | 96.27 | — | 10.82 | 3.51 |
| | | 2.1:1:1.1 | 1.0:1 | 2 | 0.751 | 97.74 | 94.09 | 4.72 | 2.12 |
| | | 1.9:1:1.1 | 1:1.1 | 3 | 0.714 | 98.92 | 93.07 | 4.08 | 0.98 |
| 4 | W | 1.6:1.2:1 | 1:1.4 | 1 | 0.906 | 96.72 | — | 10.60 | 2.45 |
| | | 1.5:1:1.1 | 1:1.4 | 2 | 0.759 | 99.06 | 95.81 | 8.05 | 0.62 |
| | | 1.6:1:1.1 | 1:1.3 | 3 | 0.709 | 100.00 | 95.81 | — | — |
| | | 70% Acetic | | | | | | | |
| 5 | D | 21:1:2.4 | 6.2:1 | 1 | 1.04 | 96.66 | — | 5.46 | 20.32 |
| | | 16:1:2.4 | 4.7:1 | 2 | 0.863 | 93.39 | 90.27 | 2.16 | 37.12 |
| | | 15:1:2.7 | 4.1:1 | 3 | 0.750 | 97.17 | 87.71 | 4.20 | 15.25 |
| 6 | D | 9.3:1:2.5 | 2.7:1 | 1 | 0.922 | 92.37 | — | 4.96 | 21.16 |
| | | 7.8:1:2.6 | 2.2:1 | 2 | 0.712 | 94.37 | 87.17 | 4.67 | 11.99 |

TABLE I-continued

ACETIC ACID EXTRACTION DATA

| Example No. | System Weight Ratios Oil:$H_2O$:Acetic | Oil:Solvent | Stage | N Content of Raffinate Oil Wt. % | Oil Recovered in Raffinate, Wt. % Each Stage | Cumulative | N Content of Extracted Oil Wt. % | Oil Dissolved in Solvent Phase Wt. % of Solution |
|---|---|---|---|---|---|---|---|---|
| | 7.2:1:2.1 | 2.3:1 | 3 | 0.664 | 97.59 | 85.07 | 3.86 | 5.18 |

(D - Dry Oil; L - Low Pour Point Oil; W - Oil in Emulsion with Water)

TABLE II

ACETIC ACID EXTRACTION DATA

| Example No. | | System Weight Ratios Oil:$H_2O$:Acetic | Oil:Solvent | Stage | N Content of Raffinate Oil Wt. % | Oil Recovered in Raffinate, Wt. % Each Stage | Cumulative | N Content of Extracted Oil Wt. % | Oil Dissolved in Solvent Phase Wt. % of Solution |
|---|---|---|---|---|---|---|---|---|---|
| 7 | W | 5.6:1:2.0 | 1.9:1 | 1 | 0.850 | 94.45 | — | 3.01 | 11.32 |
| | | 15:1:6.6 | 2.0:1 | 2 | 0.543 | 93.09 | 87.92 | 6.04 | 14.40 |
| | | 21:1:9.4 | 2.1:1 | 3 | 0.468 | 92.79 | 81.58 | 3.73 | 19.08 |
| | | 80% Acetic | | | | | | | |
| 8 | L | 9.0:1:5.4 | 1.4:1 | 1 | 0.643 | 84.42 | — | 4.54 | 18.95 |
| | | 8.3:1:5.8 | 1.2:1 | 2 | 0.474 | 100.00 | 84.42 | 4.02 | 7.71 |
| | | 8.1:1:5.8 | 1.2:1 | 3 | 0.437 | 96.74 | 81.66 | 2.18 | 4.12 |
| 9 | W | 3.6:1:4.2 | 1:1.4 | 1 | 0.699 | 88.77 | — | 6.48 | 6.94 |
| | | 5.1:1:8.2 | 1:1.8 | 2 | 0.464 | 91.63 | 77.90 | 3.37 | 6.08 |
| | | 7.4:1:10 | 1:1.5 | 3 | 0.452 | 97.63 | 76.06 | 6.57 | 1.52 |
| | | 90% Acetic | | | | | | | |
| 10 | D | 90:1:9.3 | 8.7:1 | 1 | 0.959 | 96.52 | — | 5.72 | 26.21 |
| | | 65:1:9.5 | 6.2:1 | 2 | 0.809 | 92.92 | 89.69 | 4.15 | 38.11 |
| | | 61:1:10 | 5.5:1 | 3 | 0.695 | 93.06 | 83.47 | 3.57 | 34.20 |
| 11 | D | 7.4:1:8 | 1:1.2 | 1 | 0.468 | 79.47 | — | 4.80 | 15.43 |
| | | 8.2:1:10 | 1:1.3 | 2 | 0.401 | 85.36 | 67.83 | 1.87 | 11.24 |
| | | 7.8:1:10 | 1:1.4 | 3 | 0.346 | 88.72 | 60.18 | 0.65 | 7.71 |
| | | 95% Acetic | | | | | | | |
| 12 | D | 18:1:20 | 1:1.2 | 1 | 0.379 | 75.53 | — | 3.48 | 17.54 |
| | | 15:1:21 | 1:1.5 | 2 | 0.409 | 86.22 | 65.12 | 0.88 | 6.79 |
| | | 7.8:1:11 | 1:1.5 | 3 | 0.298 | 91.87 | 59.82 | — | 6.09 |

(D - Dry Oil; L - Low Pour Point Oil; W - Oil in Emulsion with Water)

TABLE III

FORMIC ACID EXTRACTION DATA

| Example No. | | System Weight Ratios Oil:$H_2O$:Formic | Oil:Solvent | Stage | N Content of raffinate Oil Wt. % | Oil Recovered in Raffinate, Wt. % Each Stage | Cumulative | N Content of Extracted Oil Wt. % | Oil Dissolved in Solvent Phase Wt. % of Solution |
|---|---|---|---|---|---|---|---|---|---|
| | | 35% Formic | | | | | | | |
| 13 | D | 31:1.9:1 | 10.3:1 | 1 | 1.02 | 98.45 | — | 6.45 | 24.34 |
| | | 25:2.1:1 | 8.1:1 | 2 | 0.754 | 99.10 | 97.56 | 6.95 | 11.79 |
| 14 | D | 27:2.1:1 | 8.7:1 | 1 | 0.957 | 98.62 | — | 7.03 | 15.79 |
| | | 21:1.9:1 | 7.2:1 | 2 | 0.708 | 98.99 | 97.63 | 6.93 | 10.68 |
| | | 17:1.6:1 | 6.5:1 | 3 | 0.711 | 99.00 | 96.66 | 6.62 | 7.55 |
| | | 50% Formic | | | | | | | |
| 15 | D | 5:1.1:1.1 | 2.4:1 | 1 | 0.519 | 95.69 | — | 9.41 | 10.63 |
| | | 5:2.1:1.2 | 2.4:1 | 2 | 0.336 | 96.64 | 92.47 | 4.35 | 7.58 |
| | | 5:1.1:1.2 | 2.3:1 | 3 | 0.467 | 97.00 | 89.70 | 3.67 | 5.71 |
| 16 | L | 1.9:1:1.0 | 1:1.1 | 1 | 0.643 | 92.26 | — | 5.47 | 7.69 |
| | | 1.8:1:1.2 | 1:1.2 | 2 | 0.387 | 94.47 | 87.16 | 4.91 | 4.49 |
| | | 1.6:1:1.1 | 1:1.3 | 3 | 0.324 | 96.30 | 83.93 | 4.96 | 2.42 |
| 17 | W | 1.3:1.0:1 | 1:1.5 | 1 | 0.533 | 92.74 | — | 5.42 | 5.54 |
| | | 1.7:1:1.2 | 1:1.3 | 2 | 0.516 | 95.50 | 88.57 | 1.59 | 3.14 |
| | | 1.4:1:1.2 | 1:1.6 | 3 | 0.503 | 96.08 | 85.09 | 1.59 | 2.52 |
| | | 75% Formic | | | | | | | |
| 18 | D | 17:1:2.7 | 4.6:1 | 1 | 1.25 | 94.83 | — | 5.14 | 29.39 |
| | | 6.6:1:2.4 | 1.9:1 | 2 | 0.577 | 86.76 | 82.27 | 4.10 | 28.05 |
| | | 15:1:2.9 | 3.8:1 | 3 | 0.410 | 95.62 | 78.66 | 6.39 | 17.47 |
| 19 | D | 8.6:1:2.6 | 2.4:1 | 1 | 0.709 | 89.30 | — | 4.87 | 23.64 |
| | | 7.3:1:3.8 | 1.5:1 | 2 | 0.403 | 91.30 | 81.53 | 3.78 | 14.52 |
| | | 11:1:4.3 | 2.1:1 | 3 | 0.381 | 82.20 | 67.02 | 3.59 | 6.12 |

(D - Dry Oil; L - Low Pour Point Oil; W - Oil in Emulsion with Water)

TABLE IV

FORMIC ACID EXTRACTION DATA

| Example No. | | System Weight Ratios Oil:$H_2O$:Formic | Oil:Solvent | Stage | N Content of Raffinate Oil Wt. % | Oil Recovered in Raffinate, Wt. % Each Stage | Cumulative | N Content of Extracted Oil Wt. % | Oil Dissolved in Solvent Phase Wt. % of Solution |
|---|---|---|---|---|---|---|---|---|---|
| 20 | W | 5.1:1:2.3 | 1.5:1 | 1 | 0.576 | 86.58 | — | 4.34 | 22.14 |
| | | 14:1:6.0 | 2.0:1 | 2 | 0.342 | 86.03 | 74.48 | 2.54 | 22.02 |
| | | 17.1:8.6 | 1.8:1 | 3 | 0.330 | 95.86 | 71.40 | 0.24 | 8.34 |
| 21 | D | 11:1:2.9 | 2.8:1 | 1 | 0.802 | 85.87 | — | 3.82 | 40.40 |
| | | 6.2:1:2.5 | 1.8:1 | 2 | 0.518 | 91.17 | 78.28 | 4.67 | 15.43 |
| | | 7.4:1:2.4 | 2.2:1 | 3 | 0.421 | 97.49 | 76.32 | 3.73 | 6.44 |
| | | 80% Formic | | | | | | | |
| 22 | D | 37:1:3.9 | 7.6:1 | 1 | 1.03 | 97.34 | — | 5.31 | 33.54 |
| | | 18:1:2.6 | 5.0:1 | 2 | 0.739 | 96.10 | 93.55 | 5.01 | 27.55 |
| | | 14:1:2.4 | 4.1:1 | 3 | 0.690 | 94.72 | 88.61 | 3.48 | 37.34 |
| 23 | W | 3.6:1:4.2 | 1:1.4 | 1 | 0.533 | 81.04 | — | 12.43 | 12.68 |
| | | 6.3:1:8.3 | 1:1.5 | 2 | 0.383 | 94.09 | 76.25 | 3.24 | 4.63 |
| | | 6.0:1:8.6 | 1:1.6 | 3 | 0.304 | 97.70 | 74.50 | 2.03 | 1.48 |
| | | 86% Formic | | | | | | | |
| 24 | D | 9:1:5.1 | 3.1:1 | 1 | 0.384 | 70.97 | — | 3.31 | 49.63 |
| | | 15:1:4.4 | 2.8:1 | 2 | 0.246 | 96.29 | 68.33 | 3.38 | 9.46 |
| | | 15:1:4.6 | 2.7:1 | 3 | 0.153 | 98.98 | 67.63 | 6.82 | 4.10 |
| 25 | L | 8.0:1:6.0 | 1.1:1 | 1 | 0.387 | 76.69 | — | 4.09 | 22.74 |
| | | 8.7:1:6.1 | 1.2:1 | 2 | 0.257 | 96.52 | 74.02 | 3.24 | 4.01 |
| | | 7.3:1:5.4 | 1.1:1 | 3 | 0.214 | 97.91 | 72.47 | 2.91 | 2.41 |

(D - Dry Oil; L - Low Pour Point Oil; W - Oil in Emulsion with Water)

Examples 1–25 show that it is possible to remove up to 90 percent and more of the initial nitrogen present in shale oil by extraction with a selective solvent. The quantitative relationship between shale oil loss and nitrogen removal is of importance in design and economic value of a process making use of this extraction method. To determine this relationship curves were prepared by plotting the percentage nitrogen removed versus percent shale oil recovered. The percent nitrogen removed was calculated by the following equation wherein N content is the nitrogen content of the raffinate in weight percent:

$$\frac{1.3\% - \text{N Content} \times 100\%}{1.3\%} = \text{Percent Nitrogen Removed}$$

The percentage shale oil recovered was taken directly from the above Tables using the cumulative figures for the second and third extraction stages. Standard curve fit analysis programs were applied to this data with the following results.

Percent nitrogen recovered versus percent oil recovered curve fit analysis.

| Equation | INDEX OF DETERMINATION Acetic Acid | Formic Acid |
|---|---|---|
| Linear | 0.816 | 0.639 |
| Exponential | 0.721 | 0.393 |
| Power | 0.681 | 0.380 |
| 1° Polynomial | 0.811 | 0.631 |
| 2° Polynomial | 0.849 | 0.646 |
| 3° Polynomial | 0.846 | 0.641 |

For both formic acid and acetic acid, the second degree polynomial equation provides the best fit to the experimental data. The derived equations are:

For acetic acid $$Y = -0.0275X^2 + 3.021X - 6.450$$

For formic acid:

$$Y = -0.0360X^2 + 4.482X - 59.418$$

wherein Y equals percent nitrogen removed and X equals percent shale oil recovered.

The following Table V lists the percent nitrogen removed values for various percent oil recovery levels calculated using the above equations.

TABLE V

| Percent Shale Oil Recovered | Percent Nitrogen Removed Acetic Acid | Formic Acid |
|---|---|---|
| 95 | 32.36 | 41.11 |
| 90 | 42.69 | 52.04 |
| 85 | 51.65 | 61.16 |
| 80 | 59.23 | 68.49 |
| 75 | 65.44 | 74.01 |
| 70 | 70.27 | 77.73 |
| 65 | 73.73 | 79.64 |
| 60 | 75.81 | 79.76 |
| 55 | 76.52 | 78.07 |
| 50 | 75.85 | 74.68 |

As is shown, extractions using formic acid remove more nitrogen at a given level of oil recovery than extractions using acetic acid for shale oil recovery values greater than 50 percent.

Variation of raffinate nitrogen concentration and shale oil recovery with acid concentration in the selective solvent is shown in Tables I–IV. The more concentrated the acid (i.e. the less water it contains) the greater the amount of nitrogen removed and the greater the consequent shale oil loss. For a given acid concentration increasing the selective solvent-to-oil ratio has the same effect.

EXAMPLES 26–29

The following examples 26–29 demonstrate the effect of temperature on the extraction process. By increasing the temperature of the extraction process, the shale oil became less viscous. The less viscous shale oil provided better phase disengagement and separation than extractions conducted at lower temperatures.

There were no significant changes in the amount of nitrogen extracted or in percentage shale oil recovered over similar extractions performed at lower temperatures.

Examples 26–29 were conducted in the manner of Examples 1–25 in all essential details with the exception that centrifugation was not used to bring about phase separation. The phase separation occurred readily with settling.

The results of extractions conducted with acetic acid and formic acid in a temperature of 50° to 60° C. are listed in Table VI.

Table VII shows a comparison of high temperature extraction versus room temperature extractions. Table VII shows a comparison of Examples 26–29 which were for extractions conducted in a temperature range of 50° to 60° C. with extractions conducted under respectively identical conditions except that the temperature was room temperature.

TABLE VI

HIGH TEMPERATURE ORGANIC ACID EXTRACTIONS

| Example No. | Stage | Component Ratios Oil:$H_2O$:Acid | Component Ratios Oil:Solvent | Nitrogen in Raffinate Wt. % | Nitrogen Removed Wt. % | Oil Recovered in Raffinate, Wt. % Each Stage | Oil Recovered in Raffinate, Wt. % Cumulative | Nitrogen in Extracted Oil Wt. % | Oil Dissolved in Solvent Phase Wt. % of Solution |
|---|---|---|---|---|---|---|---|---|---|
| | | | | | Acetic Acid | | | | |
| 26 | 1 | 8.6:1:7.9 | 1:1.0 | 0.437 | 66.38 | 75.11 | — | 2.31 | 21.91 |
| | 2 | 9.8:1:9.6 | 1:1.1 | 0.272 | 79.08 | 87.86 | 65.99 | 0.50 | 11.06 |
| | 3 | 8.0:1:9.4 | 1:1.3 | 0.217 | 83.31 | 91.23 | 60.20 | 0.19 | 7.60 |
| 27 | 1 | 6.4:1:8.7 | 1:1.5 | 0.352 | 72.92 | 72.27 | — | 2.39 | 18.19 |
| | 2 | 6.5:1:9.2 | 1:1.6 | 0.223 | 82.85 | 87.03 | 62.90 | 0.32 | 8.01 |
| | 3 | 5.5:1:9.3 | 1:1.9 | 0.161 | 87.62 | 88.18 | 55.47 | 1.31 | 7.07 |
| | | | | | Formic Acid | | | | |
| 28 | 1 | 33.3:1:5.0 | 5.6:1 | 0.460 | 64.62 | 78.87 | — | 3.51 | 57.62 |
| | 2 | 32.8:1:4.7 | 5.7:1 | 0.307 | 76.38 | 95.01 | 74.93 | 2.64 | 24.31 |
| | 3 | 29.0:1:4.6 | 5.2:1 | 0.307 | 76.38 | 98.78 | 74.02 | 3.42 | 5.02 |
| 29 | 1 | 9.2:1:2.1 | 3.0:1 | 0.693 | 46.69 | 86.60 | — | 4.59 | 31.55 |
| | 2 | 7.9:1:2.2 | 2.5:1 | 0.417 | 67.92 | 93.00 | 80.54 | 2.68 | 15.52 |
| | 3 | 8.7:1:2.2 | 2.8:1 | 0.380 | 70.77 | 98.17 | 79.06 | 3.10 | 5.09 |

TABLE VII

HIGH TEMPERATURE EXTRACTIONS vs ROOM TEMPERATURE EXTRACTIONS

| Example No. | Stage | Oil:Solvent | Nitrogen Removed Wt. % | Oil Recovered in Raffinate, Wt. % Each Stage | Oil Recovered in Raffinate, Wt. % Cumulative |
|---|---|---|---|---|---|
| | 90% Acetic Acid at 50°–60° C. | | | | |
| 26 | 1 | 1:1.0 | 66.38 | 75.11 | — |
| | 2 | 1:1.1 | 79.08 | 87.86 | 65.99 |
| | 3 | 1:1.3 | 83.31 | 91.23 | 60.20 |
| | 90% Acetic at Acid Room Temperature | | | | |
| | 1 | 1:1.1 | 61.23 | 77.82 | — |
| | 2 | 1:1.4 | 75.00 | 81.58 | 63.48 |
| | 3 | 1:1.4 | 79.23 | 95.84 | 60.84 |
| | 90% Acetic at 50°–60° C. | | | | |
| 27 | 1 | 1:1.5 | 72.92 | 72.27 | — |
| | 2 | 1:1.6 | 82.85 | 87.03 | 62.90 |
| | 3 | 1:1.9 | 87.62 | 88.18 | 55.47 |
| | 90% Acetic at Room Temperature | | | | |
| | 1 | 1:1.2 | 64.00 | 79.47 | — |
| | 2 | 1:1.3 | 69.15 | 85.36 | 67.83 |
| | 3 | 1:1.4 | 73.38 | 88.72 | 60.18 |
| | 80% Formic Acid at 50°–60° C. | | | | |
| 28 | 1 | 5.6:1 | 64.62 | 78.87 | — |
| | 2 | 5.7:1 | 76.38 | 95.01 | 74.93 |
| | 3 | 5.2:1 | 76.38 | 98.78 | 74.02 |
| | 80% Formic Acid at Room Temperature | | | | |
| | 1 | 7.6:1 | 20.77 | 97.34 | — |
| | 2 | 5.0:1 | 43.15 | 96.10 | 93.55 |
| | 3 | 4.1:1 | 46.92 | 94.72 | 88.61 |
| | 68% Formic Acid at 50°–60° C. | | | | |
| 29 | 1 | 3.0:1 | 46.69 | 86.60 | — |

TABLE VII-continued

HIGH TEMPERATURE EXTRACTIONS vs ROOM TEMPERATURE EXTRACTIONS

| Example No. | Stage | Oil:Solvent | Nitrogen Removed Wt. % | Oil Recovered in Raffinate, Wt. % Each Stage | Oil Recovered in Raffinate, Wt. % Cumulative |
|---|---|---|---|---|---|
| | 2 | 2.5:1 | 67.92 | 93.00 | 80.54 |
| | 3 | 2.8:1 | 70.77 | 98.17 | 79.06 |
| | 72% Formic Acid at Room Temperature | | | | |
| | 1 | 2.4:1 | 45.46 | 89.30 | — |
| | 2 | 1.5:1 | 69.00 | 91.30 | 81.53 |
| | 3 | 2.1:1 | 70.69 | 82.20 | 67.02 |

The removal of nitrogen-containing compounds by extraction with the selective solvents is believed to operate by a combination of solvation and protonation. The organic acids are able to extract the basic nitrogen-containing compounds because of proton donor capability of the acids and the nonbasic nitrogen-containing compounds by the solvation properties of such acids towards the polar non-basic nitrogen-containing molecules. The organic acids of the selective solvent are miscible with hydrocarbons and nitrogen-substituted hydrocarbons providing for effective contact with the shale oil. The minor fraction of water in the selective solvent provides phase separation between the selective solvent pregnant with absorbed polar nitrogen-containing shale oil compounds and the non-polar, non-nitrogen-containing shale oil hydrocarbons.

EXAMPLES 30–32

The following examples illustrate the utility of using trichloroacetic acid in aqueous solution as the selective solvent. During these experiments the nitrogen content of shale oil was reduced by extracting the shale oil with the trichloroacetic acid and water selective solvent. The shale oil had an initial nitrogen content of about 1.3 percent by weight nitrogen. The selective solvent in the Examples was 90 percent by weight trichloroacetic acid in water.

Single stage batch extractions were carried out and the resulting data is shown in the following Table VIII.

Examples 31 and 32 were conducted in the presence of a solvent for the shale oil. Pentane was selected as the solvent. The pentane exhibited a strong affinity for the hydrocarbons present in the shale oil and thereby performed to reduce the amount of non-nitrogen-containing shale oil extracted in the selective solvent.

The results indicate that the nitrogen-containing compounds present in shale oil have a strong solubility preference for trichloroacetic acid solution over the original shale oil matrix. Over 85 percent of the nitrogen-containing compounds were removed by a single contact with the selective solvent.

The use of pentane to dissolve the shale oil phase greatly increased the shale oil recovery. At a 5:1 pentane to shale oil ratio, over 80 percent of the nitrogen was removed and recovery of the shale oil was better than 85 percent.

TABLE VII

TRICHLOROACETIC ACID EXTRACTIONS

| Example No. | System Weight Ratios $C_5$:Oil:$H_2O$:TCA | $C_5$:Oil-Solvent | N Content of Raffinate Oil Wt. % | Oil Recovered in Raffinate, Wt. % | N Content of Extracted Oil Wt. % | Oil Dissolved in Solvent Phase Wt. % of Solution |
|---|---|---|---|---|---|---|
| 30 | 0.0:6.1:1:9.0 | 0.0:1:1.6 | 0.177 | 45.33 | 3.03 | 28.53 |
| 31 | 9.7:6.9:1:8.8 | 1.4:1:1.4 | 0.168 | 69.30 | 5.67 | 16.68 |
| 32 | 3.5:6.4:1:9.0 | 5.5:1:1.6 | 0.240 | 85.67 | 14.47 | 6.08 |

What is claimed is:

1. A method for reducing the nitrogen content of crude shale oil by removing nitrogen-containing compounds from crude shale oil, comprising the steps of:

extracting the crude shale oil with an immiscible selective solvent for the nitrogen-containing compounds, the selective solvent consisting essentially of water in an amount up to about ten percent by weight and an organic acid selected from the group consisting of formic acid, acetic acid, and mixtures thereof; and separating the immiscible selective solvent containing nitrogen-containing compounds from the shale oil having a reduced nitrogen content.

2. A method as recited in claim 1 wherein the crude shale oil is crude shale oil produced by the in situ retorting of oil shale.

3. A method as recited in claim 1 wherein the selective solvent comprises formic acid and from about one to ten percent by weight water.

4. A method as recited in claim 1 wherein the selective solvent comprises acetic acid and from one to ten percent by weight water.

5. A method as recited in claim 1 wherein the ratio of shale oil to selective solvent comprises from about 0.20 to about 10 parts by weight shale oil to one part by weight selective solvent.

6. A method for reducing the nitrogen content of crude shale oil by removing the nitrogen-containing compounds comprising the steps of:

extracting the crude shale oil at least once with an immiscible selective solvent for nitrogen-containing compounds, the selective solvent consisting essentially of water in an amount up to about ten percent by weight and an organic acid selected from the group consisting of formic acid, acetic acid, and mixtures thereof;

separating an immiscible selective solvent phase containing nitrogen-containing compounds from a shale oil phase having a reduced nitrogen content; and recovering the selective solvent from the selective solvent phase by separating the selective solvent from the nitrogen-containing compounds.

7. A method as recited in claim 6 wherein the recovered selective solvent is recycled for extracting nitrogen-containing compounds from shale oil containing nitrogen-containing compounds.

8. A method as recited in claim 6 wherein the extraction is conducted batchwise in at least three successive batch extractions.

9. A method as recited in claim 6 wherein the extraction is conducted by continuous countercurrent extraction.

10. A method as recited in claim 6 wherein the extraction is conducted by continuous cocurrent extraction.

11. A method as recited in claim 9 or 10 wherein the recovered selective solvent is recycled for the continuous extraction.

* * * * *